United States Patent [19]

Kuehnel et al.

[11] 4,274,003

[45] Jun. 16, 1981

[54] X-RAY DIAGNOSTIC GENERATOR COMPRISING MEANS FOR OBTAINING A SIGNAL CORRESPONDING TO THE X-RAY TUBE VOLTAGE

[75] Inventors: Werner Kuehnel, Uttenreuth; Manfred Rattner, Buckenhof, both of Fed. Rep. of Germany

[73] Assignee: Siemens Aktiengesellschaft, Berlin & Munich, Fed. Rep. of Germany

[21] Appl. No.: 108,719

[22] Filed: Dec. 31, 1979

[30] Foreign Application Priority Data

Jan. 29, 1979 [DE] Fed. Rep. of Germany ..... 2903340

[51] Int. Cl.[3] ..... H05G 1/32

[52] U.S. Cl. ..... 250/409

[58] Field of Search ..... 250/408, 409, 410

[56] References Cited

U.S. PATENT DOCUMENTS 4,200,795 4/1980 Kawamura et al. ..... 250/409

FOREIGN PATENT DOCUMENTS 2733249 2/1979 Fed. Rep. of Germany ..... 250/409

*Primary Examiner*—Alfred E. Smith
*Assistant Examiner*—T. N. Grigsby
*Attorney, Agent, or Firm*—Hill, Van Santen, Steadman, Chiara & Simpson

[57] ABSTRACT

In the exemplary embodiment, in order to obtain a signal corresponding to the x-ray tube voltage, a voltage divider is connected in parallel with the x-ray tube whose resistances are bridged over by capacitances. The resistances of the voltage divider are applied in thick film technique in the form of windings on the one side of a substrate. On the other side of the substrate, conductive layers are applied of which each capacitively bridges over a portion of the windings.

1 Claim, 2 Drawing Figures

X-RAY DIAGNOSTIC GENERATOR COMPRISING MEANS FOR OBTAINING A SIGNAL CORRESPONDING TO THE X-RAY TUBE VOLTAGE

BACKGROUND OF THE INVENTION

The invention relates to an x-ray diagnostic generator wherein, in order to obtain a signal corresponding to the x-ray tube voltage, a voltage divider is connected in parallel with the x-ray tube; resistances of the voltage divider are bridged-over via capacitances.

In a known x-ray diagnostic generator of this type, an x-ray tube is supplied by a high voltage generator. Disposed parallel to the anode-cathode path is a voltage divider which consists of two resistances between which a signal is tapped which corresponds to the x-ray tube voltage and which can serve as an actual value signal for the purpose of regulating (or controlling) the x-ray tube voltage. For frequency compensation of the tapped signal, the resistances are shunted by capacitances.

SUMMARY OF THE INVENTION

The object underlying the invention resides in providing an x-ray diagnostic generator of the type initially cited wherein temperature-and voltage-changes have a largely equal percentage effect on the resistances and therefore do not lead to measurement errors, and whereby, in addition, there results a compact construction of the measuring installation for the x-ray tube voltage.

This object is achieved in accordance with the invention by virtue of the fact that the resistances of the voltage divider are applied in thick film technology in the form of windings on the one side of the substrate, and that, on the other side of the substrate, conductive layers are applied of which each capacitively bridges over a portion of the windings. In the case of the inventive x-ray diagnostic generator, the temperature of all components for the measurement of the x-ray tube voltage is virtually the same so that temperature fluctuations are virtually not manifested in the form of measuring errors. Voltage fluctuations have a largely uniform effect on both divider resistances, so that the tapped signal is largely independent thereof. The conductive layers can likewise be applied on the substrate in thick film technology; however, also other methods for applying these films are conceivable; for example, the pressing-on of an insulating sheet onto the other side of the substrate with conductive films on the sheet facing the substrate and providing the layers.

The invention shall be explained in greater detail below on the basis of an exemplary embodiment illustrated in FIG. 2; and other objects, features and advantages will be apparent from this detailed disclosure and from the appended claims.

DETAILED DESCRIPTION

Figure 1:
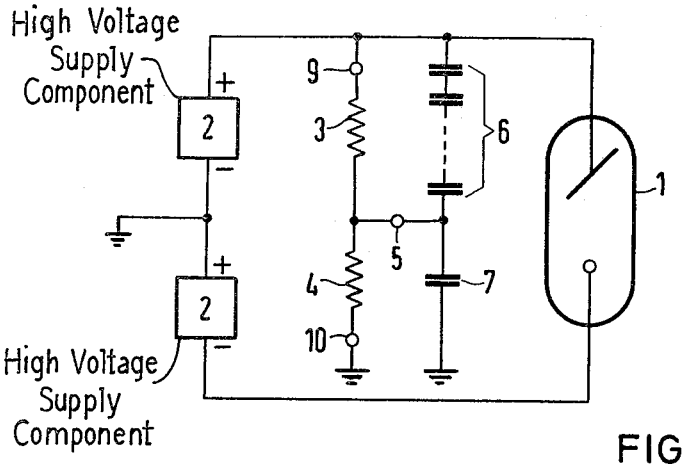
FIG. 1 is an electric circuit diagram and substantially shows a known electric circuit for obtaining a signal in accordance with an x-ray tube voltage, the circuit also serving as an approximate electric circuit diagram for use in explaining the physical voltage divider construction in accordance with the present invention.

FIG. 1 shows a known x-ray diagnostic generator comprising an x-ray tube 1 supplied by a conventional high voltage generator including high voltage supply components 2. Disposed parallel to the anode-cathode path of the x-ray tube 1 is a voltage divider which consists of two resistances 3, 4. At point 5 a signal is tapped which corresponds to the x-ray tube voltage and which can serve as an actual value signal for the purpose of controlling or regulating the x-ray tube voltage. For frequency compensation of the tapped signal, the resistances 3, 4 are shunted by capacitances 6, 7.

Figure 2:
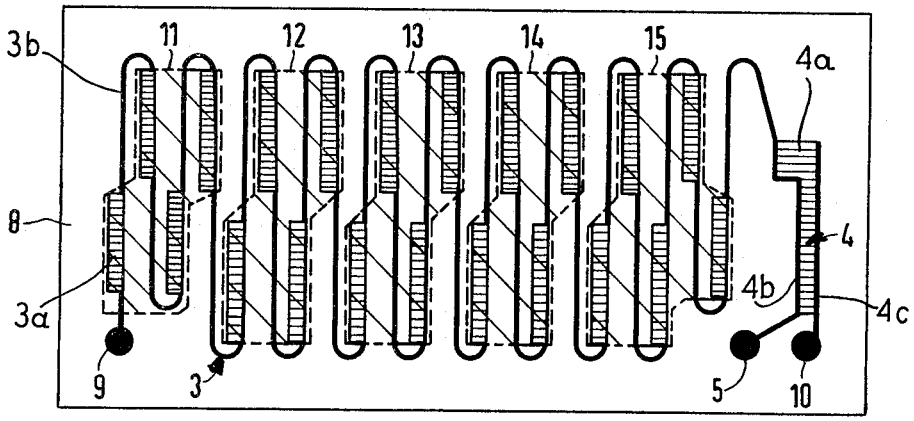
FIG. 2 shows by means of a diagrammatic plan view an embodiment of a physical voltage divider according to the present invention, and useful for implementing an electric circuit of the general type shown in FIG. 1.

FIG. 2 shows a substrate 8 on the front side of which the resistances 3, 4 are applied in meander-shape in thick film technique. The connection (or contact) 9 electrically located as indicated in FIG. 1 is disposed on the left of the substrate 8, whereas the two connections 5, 10 (also indicated in FIG. 1) are disposed on the right side of the substrate 8.

On the rear side of the substrate 8, conductive layers 11 through 15 (indicated schematically in FIG. 2 by cross-hatched outlines delineated by dash lines) are applied which capacitively bridge over and physically overlie respective portions of the meander path formed by the resistance 3. The substrate 8 here assumes the role of a high-voltage-stable dielectric. In order to obtain as high as possible a capacitance, a plurality of turns or segments of the meander path can be simultaneously capacitively bridged over, as is shown in FIG. 2, insofar as the dielectric strength permits this. The layers 11 through 15, primarily in conjunction with layers 3*a*, provide the function of the capacitance 6 of FIG. 1. The capacitance 7 must be separately connected between terminals 5 and 10 of FIG. 2. A network for frequency response correction of the tapped signal can also take the place of capacitance 7.

The resistance 3 is shown in FIG. 2 as comprising deposits of resistive material at relatively wide regions such as 3*a* interconnected at their ends in series by means of relatively narrower deposits of conductive material such as 3*b*. The high resistance deposits such as 3*a* may have relatively large areas in overlying relation to conductive layers 11–15 in comparison to the surface areas presented to the conductive layers 11–15 by the interconnecting conductive deposits such as 3*b*. The resistance 4 is shown as comprising a deposited resistive layer 4*a* of relatively small dimension in the direction of current flow in comparison to deposited layers 3*a*, the layer 4*a* having deposited conductive strips 4*b* and 4*c* at respective end margins thereof which strips 4*b* and 4*c* are connected with terminals 5 and 10, respectively.

It will be apparent that many modifications and variations may be effected without departing from the scope of the novel concepts and teachings of the present invention.

We claim as our invention:

1. In an x-ray diagnostic generator for supplying an x-ray tube wherein, in order to obtain a signal corresponding to the x-ray tube voltage, a voltage divider comprises resistance means connected in parallel with the x-ray tube, and wherein capacitance means provides a shunt path with respect to said resistance means characterized in that a substrate (8) is provided, the resistance means of the voltage divider (3, 4) comprising resistance portions (3*a*) applied in thick film technique and connected in series to form a meander path on one side of the substrate (8), and said capacitance means comprising conductive layers (11–15) applied on the other side of the substrate, each conductive layer capacitively bridging over a portion of the meander path.

* * * * *